US005910002A

United States Patent [19]

Hunter

[11] Patent Number: 5,910,002

[45] Date of Patent: Jun. 8, 1999

[54] GUN TRIGGER SAFETY DEVICE

[76] Inventor: James F. Hunter, 1225 Green Tree, Rocky Mount, N.C. 27804

[21] Appl. No.: 08/709,360

[22] Filed: Sep. 6, 1996

Related U.S. Application Data

[60] Provisional application No. 60/008,067, Oct. 30, 1995.

[51] Int. Cl.[6] ..... F41A 17/54

[52] U.S. Cl. ..... 42/70.07

[58] Field of Search ..... 42/70.01, 70.06, 42/70.07

[56] References Cited

U.S. PATENT DOCUMENTS

| | | | |
|---|---|---|---|
| D. 260,548 | 9/1981 | Holland | D22/108 |
| 2,893,152 | 7/1959 | Peluso | 42/70.07 |
| 3,020,663 | 2/1962 | Newson | 42/70.07 |
| 3,713,239 | 1/1973 | Sperling | 42/70.07 |
| 3,732,641 | 5/1973 | Adajian | 42/70.07 |
| 4,825,576 | 5/1989 | Troncoso et al. | 42/70.07 |
| 4,852,286 | 8/1989 | Troncoso et al. | 42/70.07 |
| 4,945,665 | 8/1990 | Nelson | 42/70.07 |
| 5,033,218 | 7/1991 | Nelson | 42/70.07 |
| 5,075,994 | 12/1991 | Nishioka | 42/70.07 |
| 5,371,965 | 12/1994 | Nelson | 42/70.07 |

FOREIGN PATENT DOCUMENTS

| | | | |
|---|---|---|---|
| 138331 | 12/1952 | Sweden | 42/70.07 |

*Primary Examiner*—Stephen M. Johnson
*Attorney, Agent, or Firm*—Mills & Assoc.

[57] ABSTRACT

A gun trigger safety device for double action revolvers and other guns which holds the trigger in an unfireable position is disclosed. The gun trigger safety device comprises a plug that is molded to conform to the space defined by the inner perimeter of the gun trigger guard behind the trigger. The trigger is held in an unfireable condition when the plug is properly inserted. The gun trigger safety device includes flexible, asymmetrical flanges formed on both sides thereof which partially extend around the trigger guard and the rear edge of the trigger to secure the safety device in position. The flange on the entering side of the gun trigger safety device will bend as it is pushed into the trigger guard housing behind the trigger. The leading edge of the entering flange is radiused to facilitate insertion of the device into its functional position behind the trigger. In one embodiment the asymmetrical flanges are configured so as to be released from the right side of the weapon by right handed persons. In an alternative embodiment the asymmetrical flanges are configured so as to be removed from the left side of the weapon by left handed persons. This unidirectional release function reduces the chance that a child or an uninitiated person will inadvertently release the device. The gun trigger safety device is fabricated with different surface finishes to match the guns coloration in order to disguise the fact that the weapon is in a disabled condition.

9 Claims, 4 Drawing Sheets

GUN TRIGGER SAFETY DEVICE

CLAIM OF BENEFIT FOR PROVISIONAL APPLICATION

This application claims the benefit U.S. Provisional Application No. 60/008,067, filed Oct. 30, 1995 by James F. Hunter for Gun Safety Plug.

BACKGROUND OF INVENTION

1. Field of Invention

This invention relates to gun safety devices and, more particularly, to a trigger safety device for double action revolvers and semi-automatic pistols as well as other guns, which holds the trigger in an unfired position.

Safety devices to prevent accidental firing of handguns are well known to those skilled in the art. Such safety devices are available in a variety of configurations. Trigger covers may be attached to a handgun to cover the entire trigger guard preventing access to the trigger. However, such safety covers must be attached by pins or screws and a special tool is required for release of the cover. An example of such a trigger cover is disclosed by U.S. Pat. No. 5,075,994 to Nishioka. This patent discloses a trigger cover including a locking device which is activated by a tool such as an allen wrench or a key.

Other such safety devices utilize a locking clamp which holds the trigger in a depressed position thereby preventing the weapon from being in a loaded condition. The disadvantage of this type of device is that it must be unlocked with a key if firing is necessary. Although this is effective in preventing a child from firing the gun, it may also inhibit proper use in an emergency situation while searching for the key.

Each of the safety devices described above has the added disadvantage that they may be readily seen making it apparent to the uninitiated or even a child that the weapon has been disabled. Thus, a child who finds a handgun that is disabled by an obvious safety device may be tempted to tamper with it. Further, a criminal is not likely to be deterred when confronted with a weapon having such a safety device installed thereon. Thus, any such safety device which is cumbersome to remove in an emergency situation is undesirable.

The present invention has been developed to provide a trigger safety device for double action handguns which holds the trigger in an unfireable condition and which is capable of quick release in an emergency situation. Further, the safety device of the present invention is designed to conceal the fact that the weapon is in a disabled condition.

2. Description of Related Prior Art

U.S. Pat. No. 5,075,994 to Jim Z. Nishioka discloses a trigger cover including an open position and closed position. The open position being for exposing the trigger and allowing access to an operation of the latter. The closed position being for covering and restricting access to the trigger.

U.S. Pat. Nos. 4,852,286 and 4,825,576 to Robert Troncoso et al., disclose detachable gun trigger safety devices designed to span the space between a gun trigger and the rear portion of that gun's trigger guard and wedge the trigger forward to prevent its rearward movement and firing of the gun.

U.S. Pat. Nos. 4,945,665 and 5,033,218 to Stephen G. Nelson both disclose quick-release gun trigger safety devices including a block made of a resilient material that is molded to conform to the inner perimeter of a gun trigger guard. The trigger is held in a depressed state when the block is inserted. The block has flexible flanges formed on both sides which partially extend around the trigger guard and the depressed trigger to hold the block in place.

Finally, U.S. Pat. No. Des. 260,548 to Darrell E. Holland discloses the ornamental design for a safety lock for hand gun, as shown and described.

SUMMARY OF THE INVENTION

After much research and study of the above mentioned problems, the present invention has been developed to provide a gun trigger safety device for use with double action revolvers and other guns which secures the trigger in an unfireable condition and which is capable of quick release in an emergency situation.

The gun trigger safety device comprises a plug made of a resilient material that is molded to conform to a space defined by the inner perimeter of a trigger guard housing behind the rear edge of the trigger. The trigger plug has flexible asymmetrical flanges formed about the peripheral edges thereof which partially extend around the trigger and the trigger guard to secure the trigger in an unfireable condition.

The gun trigger safety device of the present invention is designed for unidirectional installation and release to reduce the possibility of inadvertent removal of the safety device by a child or an uninitiated person.

The gun trigger safety device is fabricated in an array of colors to simulate the external finish of the weapon upon which it is installed in order to conceal the fact that the weapon is in a disabled condition.

In view of the above, it is an object of the present invention to provide a gun trigger safety device for use in combination with a double action revolver or other similar gun which holds the trigger in an unfireable condition and which is capable of quick release in an emergency situation.

Another object of the present invention is to provide a gun trigger safety device made of a resilient material that is molded to conform to the space defined by the rear edge of a trigger and the inner perimeter of a gun trigger guard.

Another object of the present invention is to provide a gun trigger safety device having asymmetrical flanges formed about the peripheral edges thereof in order to provide unidirectional installation and release of the same from behind the trigger to reduce the possibility of inadvertent removal of the device by a child or an uninitiated person.

Another object of the present invention is to provide a gun trigger safety device of various color and/or surface finishes to match the weapons color in order to disguise the fact that the same is in a disabled condition.

Other objects and advantages of the present invention will become apparent and obvious from a study of the following description and the accompanying drawings which are merely illustrative of such invention.

DETAILED DESCRIPTION OF THE PREFERRED EMBODIMENT

Figure 1:
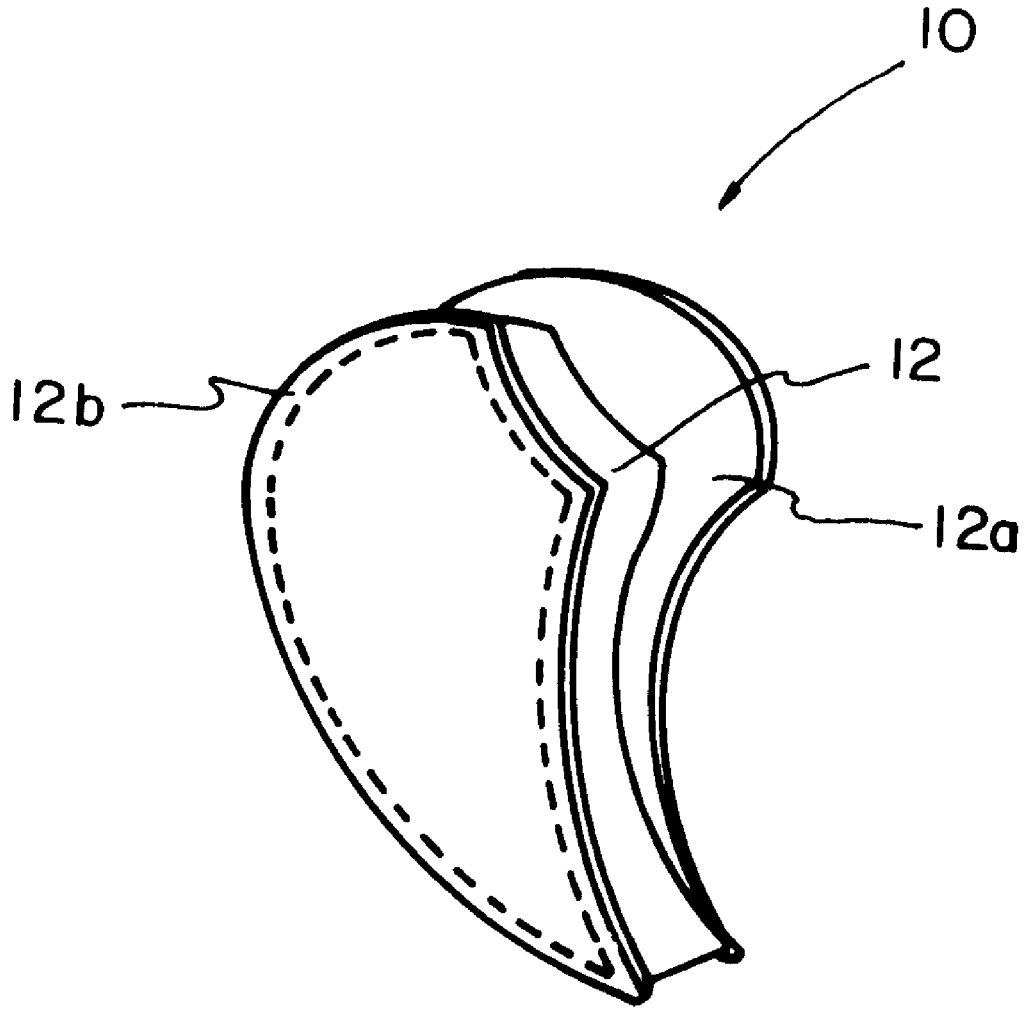
FIG. 1 is a perspective view of the gun trigger safety device of the present invention.

With reference to the drawings, a gun trigger safety device in accordance with the present invention is illustrated in FIG. 1 and indicated generally at 10.

Prior to discussing the details of the gun trigger safety device of the present invention it may be beneficial to briefly review the structure function of a double-action hand gun whereon the present invention is to be utilized.

Figure 2:
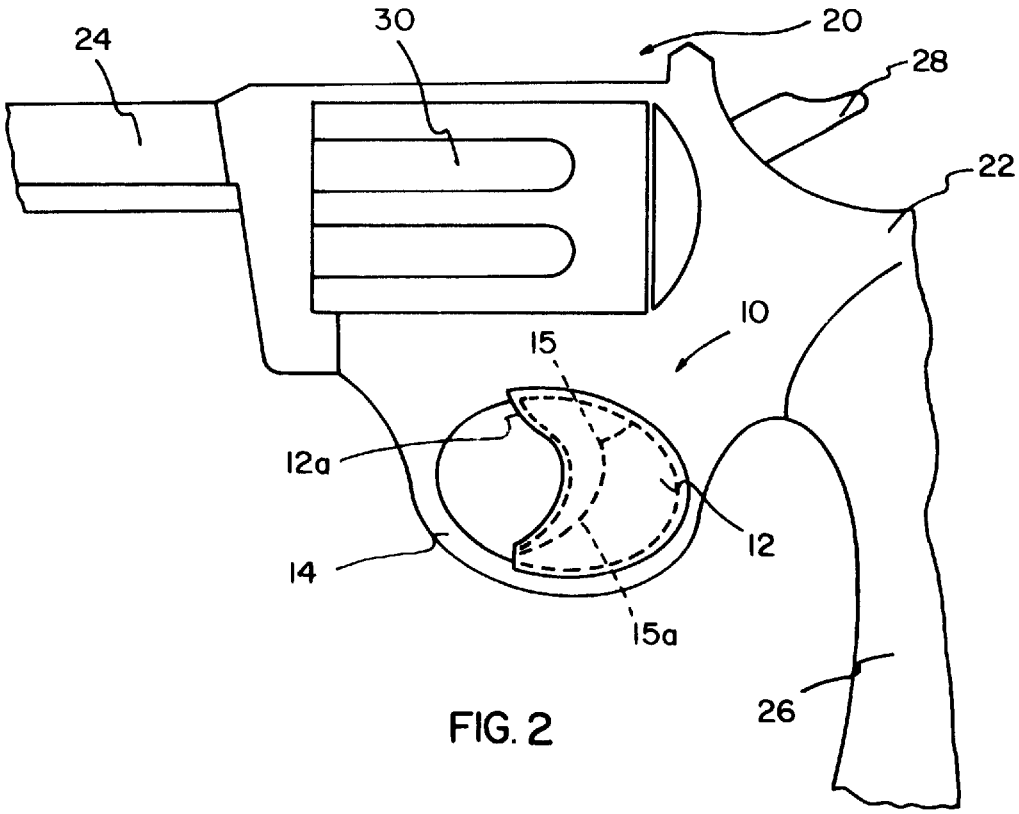
FIG. 2 is a left side elevational view of a double-action hand gun showing the gun trigger safety device of the present invention installed thereon.

Referring to FIG. 2 there is shown therein a double action hand gun or revolver indicated generally at 20. Hand gun 20 includes a frame 22, a barrel 24, a hand grip 26, a hammer 28, a trigger 15, and a trigger guard 14. Hand gun 20 further includes a rotatable chambered cylinder 30 wherein a plurality of bullets (not shown) are contained so that hand gun 20 may be fired several times without reloading.

The term double action refers to the two-part movement of the trigger 15 during operation. Depressing the trigger 15 results initially in a reverse movement or cocking of hammer 28, which in its return movement, or firing motion, revolves the chambered cylinder 30 and brings the next bullet in line for firing.

Since such double-action hand guns are well known to those skilled in the art, further detailed discussion does not seem necessary.

The details of the construction and function of the gun trigger safety device of the present invention will now be described. The trigger safety device 10 comprises a plug 12 that is shown inserted into trigger guard housing 14 behind trigger 15 of gun 20 in its functional position as shown in FIG. 2. In the preferred embodiment, plug 12 is fabricated from a resilient plastic material having physical characteristics making it incapable of compression by the finger pressure necessary to fire handgun 20.

Figure 3:
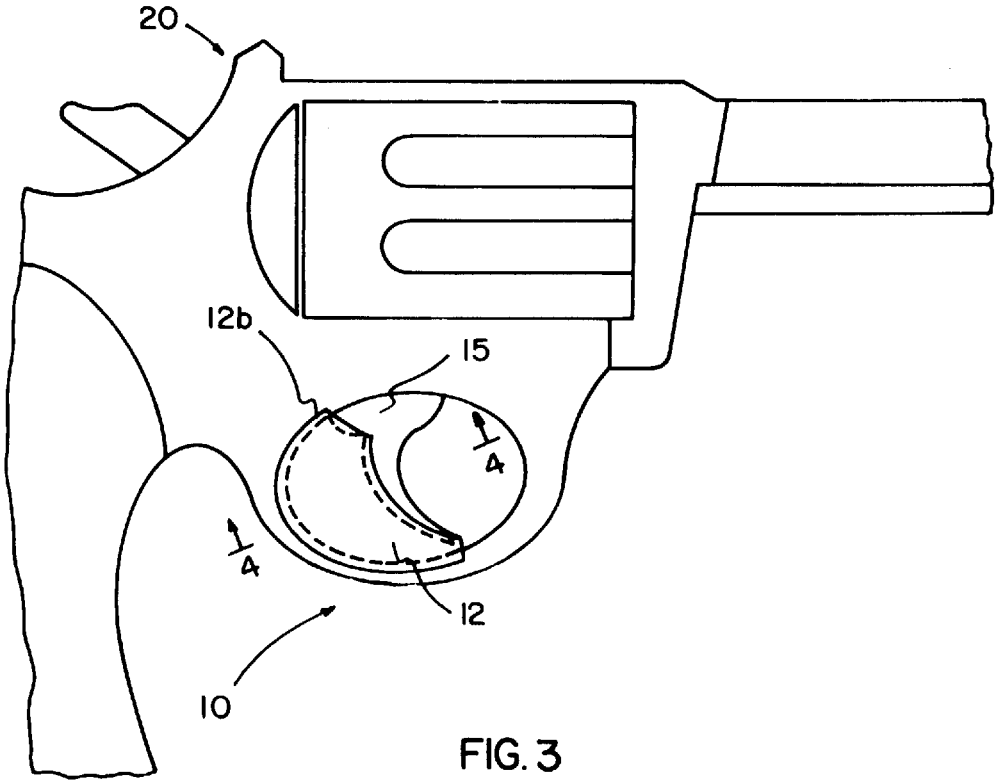
FIG. 3 is a right side elevational view of the hand gun illustrated in FIG. 2 showing the gun trigger safety device of the present invention as viewed from the opposite direction.

Referring now to FIG. 3, there is shown therein a view of handgun 20 from an opposite side thereof. Plug 12 is molded to conform to the space defined by that portion of the inner perimeter of trigger guard housing 14 behind trigger 15 and the rear edge 15*a* of trigger 15. It can be seen that plug 12 includes flanges 12*a* and 12*b* integrally formed about the entire perimeter of plug 12 and projecting outwardly on both side surfaces thereof in generally parallel relation to each other.

It will be appreciated by those skilled in the art that flanges 12*a* and 12*b* are asymmetrical by design in accordance with their undirectional release function as described hereinafter in further detail.

When plug 12 is installed in its functional position, flanges 12*a* and 12*b* partially extend around trigger guard housing 14 and trigger 15 on both sides thereof to hold the plug 12 in position as illustrated in FIGS. 2 and 3.

In the embodiment shown, the gun trigger safety device 10 is properly inserted into trigger guard housing 14 from the left side of gun 20 as shown in FIG. 2. When inserted, entering flange 12*b* on the entering side of the trigger safety device 10 will bend as the same is pushed into the trigger guard housing 14 behind trigger 15. Stop flange 12*a* on the non-entering side of the device will stop the continued movement of the same through trigger guard housing 14 as flange 12*a* comes into contact with the left side of trigger 15.

Upon reaching this position, flange 12*b* will spring back to its original configuration on the opposite side of the trigger guard housing 14 causing safety device 10 to be firmly seated in the trigger guard housing 14 behind trigger 15.

It will be noted that plug 12 is fabricated to a predetermined thickness to ensure that the dimension between flanges 12*a* and 12*b* is just slightly greater than the width of trigger guard 14 to ensure a snug fit.

Figure 4:
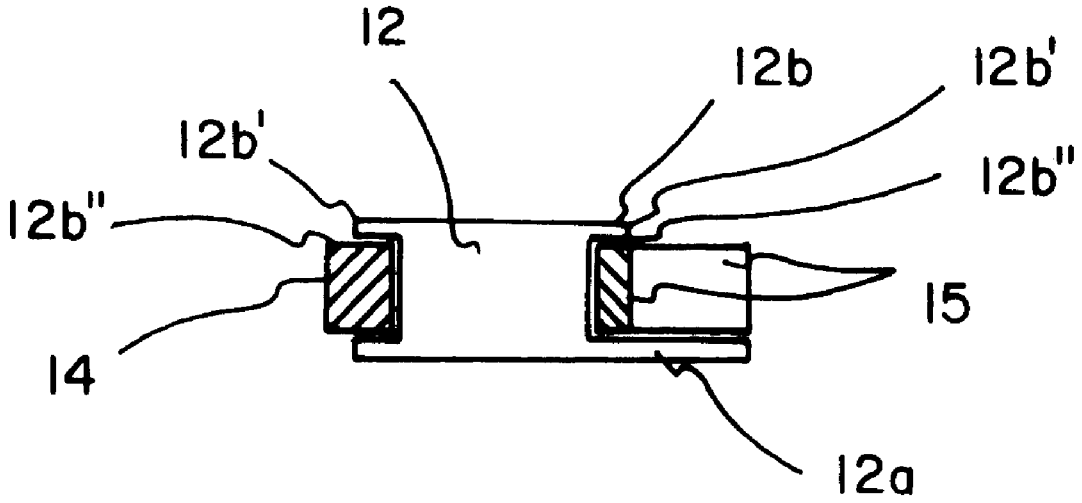
FIG. 4 is a sectional view taken on line 4—4 of FIG. 3 showing the gun trigger safety device installed in its functional position behind the trigger and within the trigger guard of the hand gun.

In the preferred embodiment, the leading edge 12*b*′ of flange 12*b* on the entering side is radiused to facilitate insertion of the safety device 10 into its functional position as shown in FIG. 4.

In contrast, the trailing edge 12*b*″ of flange 12*b* is provided with a square corner about outer periphery thereof to provide resistance when removing the device 10 from its functional position.

Gun 20 may be safely stored or carried in handbags, glove compartments, or in the field by the gun owner, law enforcement personnel, foresters and other persons with the gun trigger safety device 10 installed as described hereinabove.

In the preferred embodiment, the gun trigger safety device 10 of the present invention will be made available in different colors such as silver, black, and blue to match the color of the gun 20 on which it is to be installed. In this manner, it will not be apparent to a child or to an uninitiated person that the gun 20 has been disabled.

In order to remove the gun trigger safety device 10, adequate finger pressure on plug 12 from the right side of gun 20 overcomes the resistance provided by flange 12*b* causing the same to partially collapse allowing the safety device 10 to be dislodged from trigger guard 14 disengaging the same and making the gun 20 ready to fire.

Figure 5:
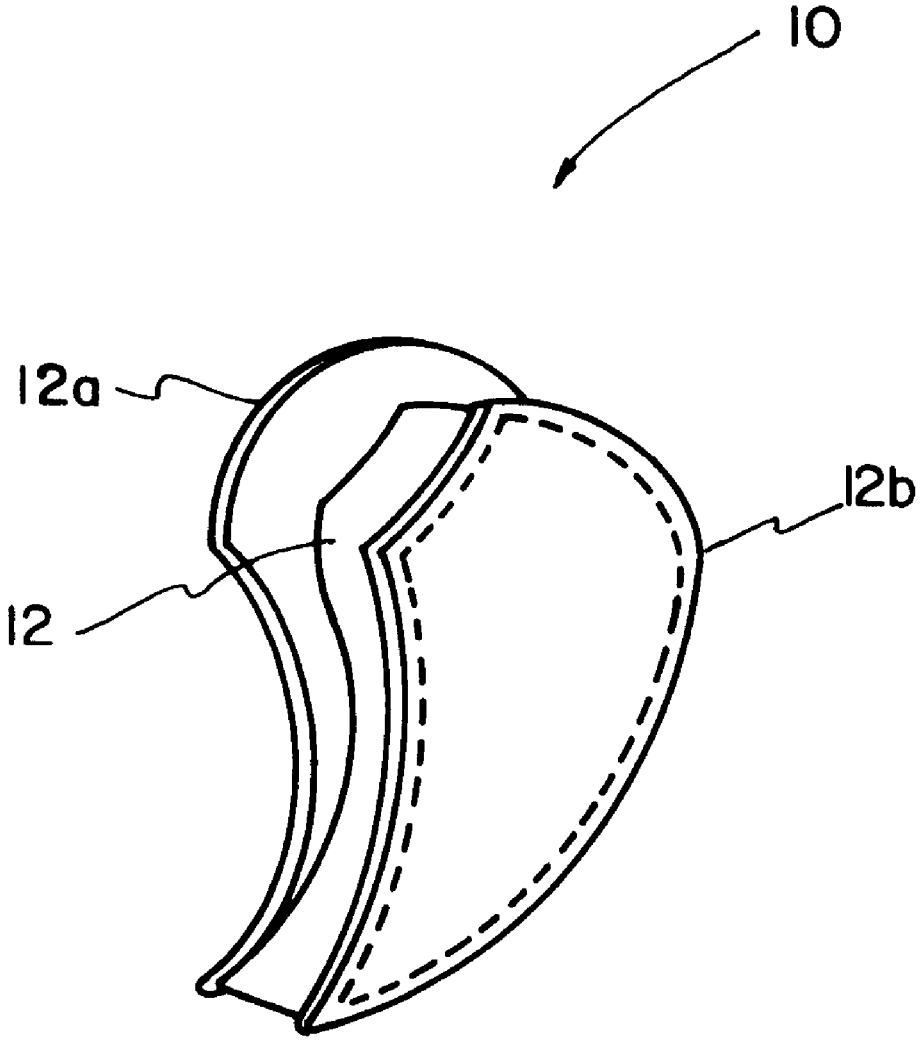
FIG. 5 is a perspective view of an alternative embodiment of the gun trigger safety device of the present invention.

Although the trigger safety device 10 of the present invention has been described as being installed and removed from only one direction, that is, removed from the right side by right handed persons, the present invention may be configured for removal from the left side by left handed persons as shown in FIG. 5.

However, it is of significance to the present invention that the gun trigger safety device 10 has not been designed for ambidextrous release from either side of handgun 20. It is believed that the trigger safety device of the present invention reduces by 50% the chance that a child or an uninitiated person will inadvertently release the safety device because it is unidirectional.

From the above it can be seen that the gun trigger safety device of the present invention provides a simple and effective trigger safety device for use in disabling a double action handgun. The gun trigger safety device is designed for unidirectional installation and release from behind the trigger and within the trigger guard of a conventional handgun. The gun trigger safety device is fabricated from a resilient material which may be colored to match the gun's color in order to disguise the fact that the weapon is in a disabled condition.

The gun trigger safety device is designed for unidirectional release to reduce the possibility of inadvertent removal of the device by a child or an uninitiated person.

The present invention can, of course, be sized to fit any firearm with a trigger and trigger guard, and is not limited to use with hand guns.

The terms "right", "left", "front", "rear" and so forth have been used herein merely for convenience to describe the present invention and its parts as oriented in the drawings. It is to be understood, however, that these terms are in no way limiting to the invention since such invention may obviously be disposed in different orientations when in use.

The present invention may, of course, be carried out in other specific ways than those herein set forth without departing from the spirit and essential characteristics of such invention. The present embodiments are, therefore, to be considered in all respects as illustrative and not restrictive, and all changes coming within the meaning and equivalency range of the appended claims are intended to be embraced therein.

What is claimed is:

1. A gun trigger safety device for use in combination with a gun having a trigger and a trigger guard, said guard having an inner perimeter disposed about said trigger, said device comprising:

trigger disabling means including a resilient plug formed to closely fit a space defined by a rear edge of said trigger and that portion of said inner perimeter of said trigger guard located behind said trigger, said plug having generally parallel side surfaces and being of approximately the same thickness as said trigger guard; and unidirectional release means including a pair of flexible asymmetrical flanges integrally formed with said plug and projecting outwardly from said side surfaces thereof in generally parallel spaced-apart relation about a periphery of said plug, said flanges conforming to the shape of said trigger guard and said trigger and partially overlapping the lateral sides thereof when said plug is installed behind said trigger, said flanges functioning to secure said plug within said inner perimeter of said trigger guard and to prevent said gun from being fired, said flanges being configured to permit insertion and release of said device in only one direction whereby the likelihood of accidental release of said device is reduced.

2. The gun trigger safety device of claim 1 wherein said device is fabricated from a resilient plastic material.

3. The gun trigger safety device of claim 1 wherein said device is fabricated from a material that matches the coloration of said gun to disguise the disabled condition thereof.

4. The gun trigger safety device of claim 1 wherein said flanges include an entering flange and a stopping flange.

5. The gun trigger safety device of claim 4 wherein said entering flange includes a leading edge and a trailing edge, said leading edge including an outside radius formed thereon to facilitate insertion of said plug into its functional position behind said trigger and within said trigger guard.

6. A method of using a gun trigger safety device in combination with a gun having a trigger and a trigger guard, said trigger guard having an inner perimeter disposed about said trigger, said safety device being formed to closely fit a space defined by a rear edge of said trigger and a portion of said inner perimeter located behind said trigger, said method comprising the steps of:

providing a resilient plug of unitary construction being configured and dimensioned to fit said space, said plug including flexible asymmetrical flange means formed about a periphery thereof and being configured to partially overlap said trigger and said trigger guard on both sides thereof;

inserting said plug into said space from a predetermined direction based on a specific configuration of said asymmetrical flange means to secure said trigger in an unfireable condition; and removing said plug from a predetermined opposite direction to place said trigger in a fireable condition.

7. The method of claim 6 wherein the steps of inserting and releasing are carried out by finger pressure.

8. The method of claim 6 wherein the step of providing further includes the step of forming a leading edge and a trailing edge on said flexible flange means, said leading edge including an outside radius formed thereon.

9. The method of claim 8 wherein step of inserting further includes the steps of:

aligning said leading edge of said flange means with said trigger and said trigger guard; and pressing said device into said space to a position of engagement wherein said leading and trailing edges partially overlap said trigger and said trigger guard on both sides thereof to secure said device in its functional position.

* * * * *